United States Patent [19]

Loder et al.

[11] 4,407,932

[45] Oct. 4, 1983

[54] FADE-RESISTANT AND ABRASION RESISTANT PHOTOGRAPHIC REPRODUCTION, METHOD OF PREPARING, AND PHOTOGRAPHIC PRODUCT THEREFOR

[75] Inventors: Harry A. Loder, Mahtomedi; Charles A. Mathna, St. Paul, both of Minn.

[73] Assignee: Minnesota Mining & Manufacturing Co., St. Paul, Minn.

[21] Appl. No.: 337,071

[22] Filed: Jan. 4, 1982

Related U.S. Application Data

[60] Division of Ser. No. 242,842, Mar. 12, 1981, abandoned, Continuation-in-part of Ser. No. 50,686, Jun. 21, 1979, abandoned.

[51] Int. Cl.[3] ..... G03C 1/90; G03C 1/84; G03C 7/00

[52] U.S. Cl. ..... 430/256; 430/263; 430/372; 430/512; 430/931

[58] Field of Search ..... 430/15, 263, 372, 512, 430/551, 931, 256, 505, 507

[56] References Cited

U.S. PATENT DOCUMENTS

| | | | |
|---|---|---|---|
| 781,469 | 1/1905 | Smith | 430/261 |
| 2,126,137 | 8/1938 | Potter | 430/261 |
| 2,182,814 | 12/1939 | Marasco | 430/259 |
| 2,266,435 | 12/1941 | Nadeau et al. | 430/259 |
| 2,330,905 | 10/1943 | Mueller | 430/259 |
| 2,366,439 | 1/1945 | Chilton et al. | 430/261 |
| 2,367,665 | 1/1945 | Capstaff | 430/261 |
| 2,370,321 | 2/1945 | Mueller | 430/259 |
| 2,409,564 | 10/1946 | Heinecke et al. | 430/263 |
| 2,448,552 | 9/1948 | Schulze | 430/261 |
| 2,462,503 | 2/1949 | Jennings | 430/261 |
| 2,492,953 | 1/1950 | Ball et al. | 430/261 |
| 2,492,954 | 1/1950 | Ball et al. | 430/261 |
| 2,562,527 | 7/1951 | Corner | 430/261 |
| 2,590,296 | 3/1952 | Coote | 430/261 |
| 2,609,291 | 9/1952 | Coote | 430/261 |
| 2,614,932 | 10/1952 | Nadeau et al. | 430/259 |
| 2,740,716 | 4/1956 | Forman | 430/259 |
| 2,843,485 | 7/1958 | Yutzy et al. | 430/248 |
| 2,993,792 | 7/1961 | Grumbine | 430/259 |
| 3,168,402 | 2/1965 | Branibar | 430/262 |
| 3,183,092 | 5/1965 | Mackey et al. | 430/259 |
| 3,282,643 | 11/1966 | Smith et al. | 430/259 |
| 3,282,698 | 11/1966 | Verlst | 430/259 |
| 3,359,107 | 12/1967 | Goffe et al. | 430/263 |
| 3,369,903 | 2/1968 | Harvey | 430/259 |
| 3,520,682 | 7/1970 | Gross | 430/248 |
| 3,647,442 | 3/1972 | Malster | 40/202 |
| 3,721,557 | 3/1973 | Inoue | 430/257 |
| 3,834,907 | 9/1974 | Bissonette | 430/538 |
| 3,933,503 | 1/1976 | Schonberg | 430/259 |
| 3,982,940 | 9/1976 | Kinjo et al. | 96/27 R |
| 4,033,770 | 7/1977 | DeHaas et al. | 430/248 |
| 4,049,483 | 9/1977 | Loder et al. | 156/230 |
| 4,059,715 | 11/1977 | Pletcher | 428/349 |
| 4,183,750 | 1/1980 | Goldberg | 430/364 |
| 4,216,286 | 8/1980 | Green et al. | 430/256 |
| 4,237,206 | 12/1980 | Fujita | 430/950 |
| 4,296,198 | 10/1981 | Trautweiler | 430/403 |

FOREIGN PATENT DOCUMENTS

| | | | |
|---|---|---|---|
| 1932056 | 1/1970 | Fed. Rep. of Germany . | |
| 2447768 | 4/1975 | Fed. Rep. of Germany . | |
| 2815072 | 10/1978 | Fed. Rep. of Germany . | |
| 1513828 | 1/1968 | France . | |
| 50-10810 | 8/1975 | Japan . | |
| WO80/02879 | 12/1980 | PCT Int'l Appl. | 430/256 |
| 2061131A | 10/1980 | United Kingdom . | |

OTHER PUBLICATIONS

Neblette, Carroll Bernard, "Handbook of Photography and Reprography", 7th Edition (Edited by Sturge, John M.), Van Nostrand Reinhold Company, New York, NY 1977, pp. 391-393.

*Primary Examiner*—Richard L. Schilling
*Attorney, Agent, or Firm*—Donald M. Sell; Richard E. Brink

[57] ABSTRACT

Method of preparing a fade-resistant and abrasion-resistant colored photographic image and a novel color photographic paper therefor. A photograph on the paper is coated with adhesive, bonded to a substrate and the paper backing stripped away, leaving a low density polyethylene foil covering the reversed image.

1 Claim, 4 Drawing Figures

FADE-RESISTANT AND ABRASION RESISTANT PHOTOGRAPHIC REPRODUCTION, METHOD OF PREPARING, AND PHOTOGRAPHIC PRODUCT THEREFOR

CROSS-REFERENCE TO RELATED APPLICATIONS

This application is a division of application Ser. No. 242,842, filed Mar. 12, 1981, now abandoned, as a continuation-in-part of application Ser. No. 50,686 filed June 21, 1979, now abandoned.

BACKGROUND OF THE INVENTION

This invention relates to the transfer of full-color photographic images to substrates, to adhesive-coated photographic paper especially adapted therefor, and to fade- and abrasion-resistant colored structures made thereby.

It is often desirable to enhance the aesthetic value of photographic works by using special techniques to simulate an oil painting on canvas. Several methods have addressed this problem, albeit with only limited success. For example, a photographic emulsion containing silver halide particles can be knife-coated or otherwise applied to a canvas under controlled light conditions, exposed to imaging radiation through a photographic negative, and the thus-exposed emulsion layer subjected to developing solutions to yield a photographic image. The irregular surface of the canvas substrate tends to cause optical distortion during exposure, and the developing solutions tend to cause shrinkage of the substrate during processing. Further, the thin and fragile emulsion layer remains unprotected, and unreinforced, necessitating the application of a lacquer coating thereover to impart durability. Even more significantly, this procedure is limited to black and white images, primarily because of the extreme difficulty in applying the precisely positioned and proportioned multiple layers of emulsion required to produce a chromatically faithful colored photographic image.

For many years photo resists for platemaking in the printing and graphic arts industry were composed on clear film or glass "flats" by adhering photographic images carried on relatively thin "permanent supports" which had been stripped from relatively thick "temporary supports" after developing; see, e.g., U.S. Pat. No. 3,282,643. These "stripping films" were classified as either "wet" or "dry", depending on the technique employed to separate the emulsion-carrying permanent support from the temporary support. U.S. Pat. No. 3,359,107 describes a stripping film having a permanent support layer which is preferably (or always) opaque white and relatively thick (25–30 micrometers).

By and large, the physical characteristics deemed essential for a stripping film drastically limit its satisfactory performance in the transfer of a colored photographic image to an irregular substrate. An extremely thin permanent support (which is desired in a stripping film) causes extreme difficulty in handling and consequent distortion, especially when a large sheet is involved. On the other hand, stretchiness (which can not be tolerated in a stripping film, where the stripped film is to be adhered to a smooth surface) is highly desirable where the stripped film is to be conformed to an irregular surface, such as canvas. A thick film minimizes the distortion problem and simplifies handling but it causes optical distortion and edge effects in the composed piece, especially where individual colored emulsion layers are superimposed. In any event, stripping films commonly use high contrast black and white emulsion or photopolymer systems rather than multiple color silver halide emulsion layers.

A currently commercial full color emulsion transfer process utilizes a "wet" stripping film. The several emulsion layers making up a full color silver halide emulsion are coated on a solvent-soluble temporary support, exposed to imaging radiation and developed; the colored emulsion image is then separated by dissolving the temporary support. The extremely delicate and unsupported emulsion image is then carefully transferred to a second surface, to which it is adhered. Since this procedure requires handling an unsupported emulsion, its practical utility is limited to those who specialize in this process.

Because of the limitations inherent in the preceding processes, other techniques have been explored in an attempt to achieve a full-color photograph on a textured substrate. For example, three photographic emulsion layers (respectively sensitive to blue, green and red), each optionally carried by its own extremely thin individual support film, may be sequentially coated on a conventional backing. The multi-layer emulsion is thereafter exposed to imaging radiation, developed and each emulsion layer in turn (on its support film, if such is present) transferred to the permanent support, making certain that the three imaged layers are in register; see, e.g., U.S. Pat. No. 2,182,814. Great care is required in handling the individual emulsion layers, and it is extremely difficult to obtain high quality results, especially if the substrate is irregular or textured.

A somewhat analogous approach is disclosed in U.S. Pat. No. 3,721,557, where individual transparent positive images of different primary colors in a photopolymer carried by a stripping layer are in turn superposed and adhered together in register on a desired substrate. Not only is it impossible to obtain full gray scale contrast or a full range of colors with photopolymers, but the several stripping layers and adhesive layers also tend to shift the color rendition unless each such layer is water-white.

Prior to the present invention, the most popular way of generating a colored photographic image on a canvas or other irregular substrate involved a process known as "'RC' photo paper stripping". This process utilizes a curl-resistant commercially available photographic print paper of the type where a relatively thick white paper has a thin polyethylene foil laminated to each major face, the multiple photographic emulsion layers being coated over the first foil surface, which normally contains white pigment. A colored photographic image is developed in the emulsion layer and the exposed surface of the second foil adhered to a supporting substrate. Exercising great care, the paper backing is then split as close to the paper-contacting face of the emulsion-coated first polyethylene foil as possible, the first foil and developed composite image being carefully removed by rolling them around a small cylindrical dowel. The exposed face of the removed polyethylene foil, bearing the developed emulsion layers on the other face, is then adhered to the canvas with a suitable heat-activated or liquid resin and subjected to pressure to conform it intimately thereto.

The results obtained by the splitting process just described are somewhat unpredictable, even though the adhesion of the polyethylene foil to the backing can be controlled; see, e.g., U.S. Pat. No. 4,237,206. The removed emulsion-bearing first polyethylene foil can retain a significant and inconsistent amount of paper fiber torn from the original base, often resulting in an irregular caliper; this in turn may impart a distorted and irregular appearance when the curled, fragile, and unsupported foil is thereafter manipulated during the mounting process. Some have addressed the handling problem by bonding a relatively thick transparent heat-activated protective film to the emulsion side of the photo print prior to stripping, the protective film overlying and protecting the imaged surface after the polyethylene supporting foil has been adhered to the canvas substrate. While use of the protective film makes it easier to handle the emulsion layer, an extra processing step is required, the time, and the added thickness of the protective film detracts from the original objective of achieving a true canvas texture in the finished work. As in all prior art colored photographic prints, fading occurs upon extended exposure to light.

In summary, prior to the present invention, there has been no simple, convenient way to achieve a faithful color rendition on an irregular substrate. Even in those situations where such a rendition has been achieved, the colors were subject to fading.

BRIEF SUMMARY OF THE INVENTION

The present invention provides a simple and easy method for attaining the aesthetic qualities of full color photographic images on canvas. The method of the invention expands the practical use of photography to the preparation of large full color murals, and also provides an inexpensive alternative to the use of expensive transparent base prints for backlighted displays. The invention also offers a high quality alternative to four-color lithographic printing where the small number of copies required would otherwise result in prohibitive unit costs. The invention lends itself to the preparation of durable, protected full color renditions for use in package mockup work. As an unexpected advantage, the invention provides products which are far more resistant to fading than any prior art products known to the inventors.

In accordance with the invention, there is provided a photographic paper comprising (1) a paper core having a face side and a back side, (2) a first low density polyethylene foil bonded to the face side but removable therefrom with a force of 6–10 grams per centimeter width, (3) a second low density polyethylene foil bonded to the back side, and (4) overlying the first foil and bonded thereto a full-color light-sensitive element comprising a plurality of superposed strata of photographic emulsions containing disposed silver halide particles, each stratum containing a photographic dye coupler, the outermost stratum containing a cyan or magenta dye coupler and the innermost stratum containing a yellow dye coupler. The specified peel adhesion between the barrier foil and the paper core is 6–10 grams per centimeter width, which is substantially less than either (a) the peel adhesion between the barrier foil and the light-sensitive element or (b) the cohesive strength of either the paper carrier sheet or the barrier foil. At the same time, this peel adhesion is sufficiently high to prevent separation during both manufacture and the subsequent handling during imaging, automatic developing and drying of the light-sensitive element.

A colored photographic image is formed by exposing the light-sensitive element through a colored negative to create a latent image and developing and fixing the latent images. This image is then transferred to any desired substrate by applying a uniform layer of adhesive over the outermost stratum, bonding the image-bearing photographic paper to the substrate via the adhesive, and stripping away the paper core and second polyethylene foil to leave a full-colored photographic reproduction bonded to said substrate. The outermost stratum of the previously light-sensitive element now contains the yellow dye, which absorbs ultraviolet radiation, whereby the photographic reproduction is rendered resistant to fading. The first polyethylene foil covers the previously light-sensitive element, whereby the photographic reproduction is protected from abrasion.

The product resulting from the steps described in the preceding paragraph is thus a full color photographic reproduction comprising in combination (a) a substrate, (b) a layer containing a full color image adhesively bonded to said substrate, said layer comprising a plurality of superposed developed and fixed silver-containing photo emulsion strata, the outermost stratum containing a yellow dye, and (c) overlying and bonded to the outermost stratum a thin low density polyethylene foil. For reasons, to be subsequently set forth in more detail, the colors in the transferred photograph display unusual resistance to fading.

BRIEF DESCRIPTION OF THE DRAWING

Understanding of the invention will be enhanced by referring to the accompanying drawing, in which thickness has been greatly exaggerated in the interest of clarity, like numbers referring to like parts in the several views.

DETAILED DESCRIPTION

Figure 1:
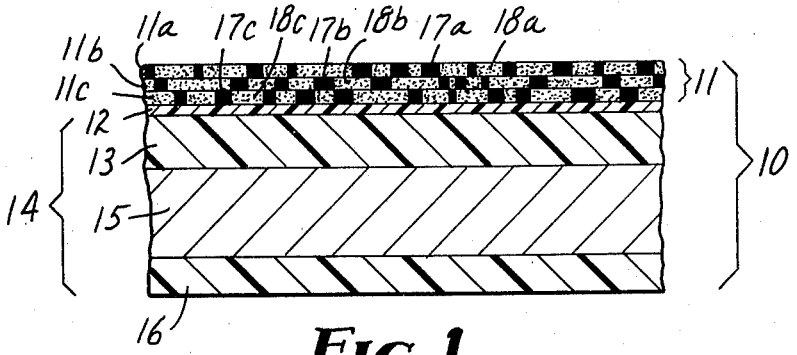
FIG. 1 is a cross-sectional view of a composite photographic structure of the invention, showing a light-sensitive element comprising imaged plural layers of colored photographic emulsions containing dispersed silver halide particles.

Considering the drawing in more detail, attention is directed to FIG. 1, where composite photographic structure 10 is shown in imaged condition, ready for transfer to a substrate. Light-sensitive positive print element 11 is made up of imaged strata 11*a*, 11*b* and 11*c* adhered to transparent low density polyethylene barrier foil 13, primer (or subbing) layer 12 being interposed to enhance adhesion. Barrier foil 13 is an integral but removable part of photographic carrier sheet 14, which also comprises paper core 15, to the back of which is laminated polymeric foil 16. (It will be appreciated, of course, that acutance dyes, filters, interlayers, antihalo layers, top coats and similar conventional components and layers may be present in element 11 to enhance the photographic performance of structure 10.)

In structure 10, each of the three strata 11*a*, 11*b*, and 11*c* has been exposed to a desired pattern of actinic radiation and thereafter developed, respectively resulting in imaged areas 17*a*, 17*b* and 17*c* and unimaged areas 18*a*, 18*b* and 18*c*. Prior to exposure, (which takes place through a color negative) 11*a*, 11*b* and 11*c* contain, respectively, a cyan-forming coupler, a magenta-forming coupler, and a yellow-forming coupler, which correspondingly respond to red, green and blue light. As a result the images in layers 11*a*, 11*b* and 11*c* are additive, and an observer gains the visual impression of a full-colored image.

Figure 2:
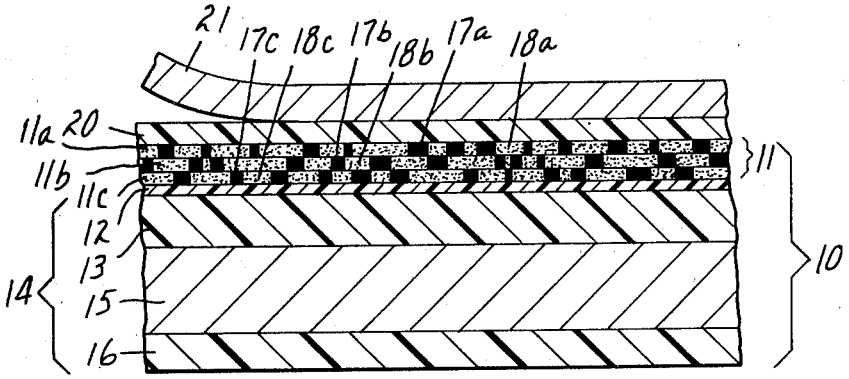
FIG. 2 is a cross-sectional view of the structure of FIG. 1, showing the application of a pressure-sensitive adhesive layer to the exposed face of the light-sensitive element.

FIG. 2 shows the preferred method of providing structure 10 with an adhesive coating. Pressure-sensitive transfer adhesive layer 20 is normally carried on release liner 21. The exposed surface of adhesive layer 20 is placed in contact with the exposed surface of imaged stratum 11*a*, and rolled into uniform contact therewith, after which release liner 21 is removed.

Figure 3:
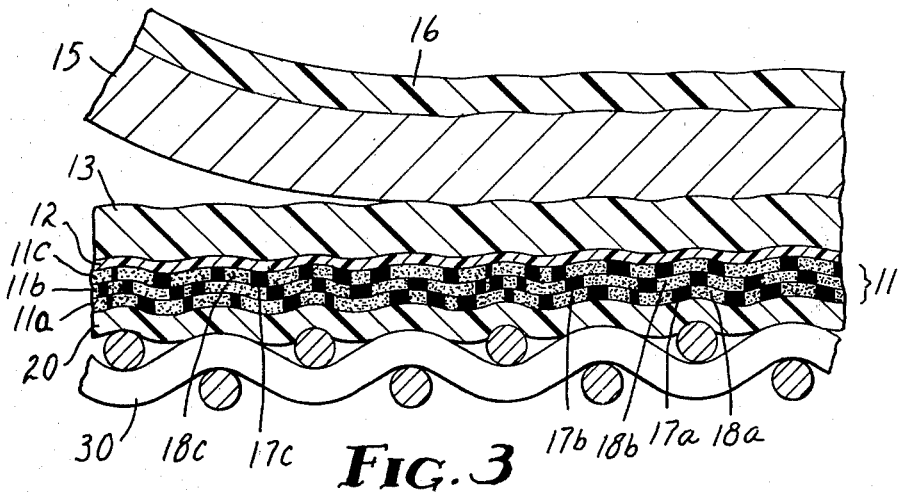
FIG. 3 is a cross-sectional view showing the structure of FIG. 2 adhered to a canvas substrate, with the original backing being stripped away.

FIG. 3 shows how the imaged and adhesive-coated composite photographic structure 10 of FIG. 2 is transferred to one face of canvas substrate 30 and paper core 15 separated from barrier foil 13, leaving the combined image of strata 11*c*, 11*b* and 11*a* adhered to substrate 30 but protectively covered by transparent polyethylene barrier foil 13. For convenience in processing photographic structure 10 and transferring imaged light-sensitive element 11 without distortion, it has been found that the force required to separate release layer 14 from barrier foil 13 should be at least about 6 g/cm width but not more than about 10 g/cm width when measured in accordance with ASTM Test D903.

Polyethylene barrier foil 13 must be sufficiently flexible and extensible to permit the transferred photographic structure to conform to the irregular surface contours of canvas or other substrate to which it is applied. It should also have sufficient strength that the force required to separate barrier foil 13 from the paper fiber interstices at the surface of core 15 will not cause it to distort or rupture. To provide a combination of adequate strength and protection, while at the same time minimizing the separation of the photographic image in light-sensitive element 11 from the viewer, the thickness of barrier foil 13 should be at least about 15 micrometers but not more than about 21 micrometers, thereby enabling structure 10 to conform to the irregularities of substrate 30. After separation from paper core 15, the then-exposed surface of barrier foil 13 has a surprisingly uniform and matte appearance, enabling glare-free viewing of the finished transferred photographic image. It has been determined that the matte surface on barrier foil 13 results from the controlled surface penetration of the polyethylene resin into the fiber interstices at the surface of paper base layer 16 during the manufacturing process.

As previously noted, layer 20 is preferably a pigmented normally tacky and pressure-sensitive adhesive, supplied on a release liner in the form of a transfer tape. Alternatively, layer 20 may comprise a curable, dryable heat-activated adhesive in the form of a solution in organic solvent, a hot melt, an aqueous solution, or a dispersion. Excellent results may be obtained using polyvinyl acetate emulsion ("white glue"), aerosol spray adhesives, etc. Application techniques include roll coating, brushing, transfer coating, etc. Especially where the surface of substrate 30 is not normally white, adhesive layer 20 desirably contains sufficient titanium dioxide or other pigment to render it opaque white, thereby providing the background necessary for true color balance in image-containing layer 11. The flexibility and conformability of adhesive layer 20 should also be consistent with the properties of barrier layer 13 and substrate 30.

The presently preferred adhesive system is an acrylic pressure-sensitive adhesive containing thin-walled, fragile glass micro-balloons. When a solution of the adhesive is coated in a thin layer and dried, the microballoons extend above the adhesive surface and allow only partial contact with a substrate to which the exposed surface is applied, permitting repositioning. The application of burnishing pressure ruptures the microballoons, permitting uniform contact and firm adhesion when the desired position has been achieved. Products of this type, containing white pigment, are available from 3M Company under the trade designation "Scotch" Brand No. 569 White Mounting Adhesives.

Another suitable adhesive system comprises a heat-activatable hot melt adhesive containing inherently tacky elastomeric copolymer microspheres, all as described in detail in U.S. Pat. No. 4,049,483. An adhesive of this type has sufficient tack to permit structure 10 to remain temporarily in a fixed position on substrate 20, the amount of tack being low enough, however, that structure 10 can be readily removed and repositioned if necessary. After structure 10 has been finally positioned, sufficient heat is supplied to the exposed surface of layer 17 to activate the hot melt adhesive component of layer 20, causing it to flow sufficiently to conform intimately to the surface irregularities of substrate 30. A press having a heated platen is preferred for activating the hot melt component of adhesive layer 20.

It will readily be appreciated that the image visible in exposed and developed light-sensitive element 11 is reversed when structure 10 is applied to a substrate. A correct rendition is easily obtained, however, by simply inverting the negative through which light-sensitive element 11 is exposed to actinic radiation.

As has been previously pointed out, light-sensitive stratum 11*a* contains a cyan-forming coupler and is responsive to red light, strata 11*b* and 11*c* containing, respectively, magenta-forming and yellow-forming couplers responding, respectively, to green and blue light. The location of stratum 11*c*, containing the yellow-forming coupler, at the innermost aspect of layer 11 is essential to prevent halation during exposure and processing of structure 10. Unfortunately, a finished color print made from photographic paper having this arrangement often fades badly upon exposure to daylight; this problem results from the fact that losses in optical densities in the cyan and magenta strata are perceived by the human eye as far greater than a loss in optical density in the yellow stratum. Prior to the present invention, no way was known to inhibit this visually apparent color loss other than applying a coating or film containing UV inhibitors over the top of the color print. Even this, however, has not been completely effective, since ordinary white light also contributes heavily to fading.

Figure 4:
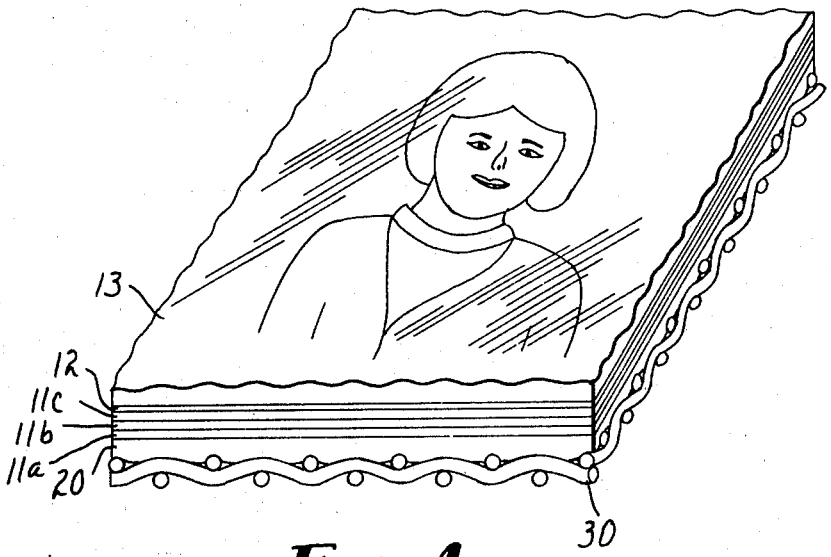
FIG. 4 shows, in perspective, a portrait-like image transferred to a canvas substrate as shown in FIG. 2.

An unexpected advantage of the present invention is the fade-resistance of the transferred color prints. In retrospect, it appears that yellow layer 11*c*, which is outermost in transferred prints like that shown in FIG. 4, functions as a filter to screen radiation (especially ultraviolet radiation) from magenta layer 11*b* and cyan layer 11*a*. Thus, the invention provides an unobvious and serendipitous solution to a long-standing problem in the photographic industry.

As a further air to understanding the invention, attention is directed to the following illustrative but non-limiting example, in which all parts are by weight unless otherwise noted.

A white photographic base paper having a basis weight of 160 g/m$^2$, a thickness of 157.5 micrometers, and a surface smoothness of 30 Sheffield (measured in accordance with TAPPI Useful Method 518) was obtained. Onto one side of the paper (referred to herein as the "back side"), a thin layer of low density polyethylene ("Gulf Polyeth" 4516) was extruded at the rate of about 91 meters/minute. The paper-polyethylene laminate was immediately passed through squeeze rolls comprising a 30.5 cm diameter rubber roll and a 30.5 cm diameter matte finish chrome steel chill roll, the latter contacting the exposed surface of the newly extruded polyethylene, at a pressure of 540 g/lineal cm contact. Temperatures and pressures were adjusted to obtain a high degree of adhesion, following well-known procedures; see, e.g., A. Renfrew & Philip Morgan, *Polythene—The Technology and Uses of Ethylene Polymers,* 2d ed., Interscience Publishers Inc., New York, 1960. The polyethylene layer was 30.5 micrometers thick and weighed 30 g/m$^2$.

Onto the other side of the paper (referred to herein as the "face side") a layer of the same low density polyethylene was then extruded at a rate of about 91 meters/minute and passed between squeeze rolls as in the preceding paragraph. Temperatures, speeds and pressures were carefully controlled to achieve an adhesion of the polyethylene to the face side in the range of 6–10 grams per centimeter of width as measured by ASTM Test D903, indicating an optimum penetration of the face side paper fibers by the polyethylene. The following operating conditions were observed:

Extruder barrel diameter—5.08 cm
Extruder L/D ratio—28
Extruder Barrel Temperatures
zone 1—247° C.
Zone 2—260° C.
Zone 3—274° C.
Zone 4—274° C.
Die temperature—274° C.
Melt temperature—271° C.
Chill roll temperature—8° C.±1.5° C.
Lamination pressure—540 g/cm±10 g/cm All temperatures were maintained ±3° C. unless otherwise specified. The resultant laminate had a face side polyethylene foil thickness of 15.2 micrometers and a polyethylene-to-face side adhesion of 6.4 grams/centimeter width.

Following the extrusion-coating process, the exposed surface of the face side polyethylene was subjected to a corona discharge treatment to attain a surface tension level of 54 dynes/cm$^2$. Onto the corona-treated surface, a 0.5% solids water-based photographic subbing solution containing gelatine, chrome alum and a wetting agent was air knife coated. Over the subbed polyethylene was then applied a conventional full color light-sensitive 3-stratum silver halide emulsion coating—yellow, magenta and cyan.

The full color photographic print paper of this example was exposed in a darkroom through a color negative, using a conventional color enlarger, and developed on an automatic roll transport color photographic processor to obtain a print 50 cm×60 cm. Over the face side of the print was then applied a single layer of "Scotch" No. 569 White Mounting Adhesive, supported on a release liner, manufactured by the 3M Company, St. Paul, Minn. The assembly was then passed through a laminator or roller machine to insure uniform contact of the adhesive with the face of the photographic print, after which the release liner was peeled away, leaving the white adhesive layer adhered to the face side of the photograph.

The exposed face of the tacky adhesive was placed in contact with a canvas cloth, having 8 threads per inch in both the warp and fill directions, and the layup run through the laminator roller machine. The carrier base paper of the photographic print was peeled away, separation occurring cleanly between the face side of the paper and the polyethylene layer, leaving the imaged full color photographic emulsion layer adhered to the canvas and protectively covered by a non-glare clear polyethylene layer. The back side of the canvas was then moistened to assure plasticity of the photographic emulsion layer, and placed in a platen press at 150 kPa, the polyethylene in contact with a 2.5-cm thick foam pad and the canvas in contact with an 80° C. platen, for one minute. A deeply textured photographic print, corresponding to the underlying canvas pattern, was obtained, the print being protectively covered by a thin, supple polyethylene layer having a non-glare matte surface.

An experiment was conducted to evaluate the relative color stability of (1) the photographic reproduction of the invention, where the protective matte transparent polyethylene layer is on top of the inverted imaged emulsion and (2) an uninverted imaged sheet, as in a normally mounted colored photograph. Specifically, the experiment was conducted as follows:

Sheets of the photographic structure of the invention were exposed through a color-banded test negative and processed according to standard color darkroom procedures. The test prints were then mounted on white paper-faced card stock in the following manner. One portion of the full visible spectrum print was cut and the emulsion side adhered to the card stock with "Scotch" No. 568 unpigmented adhesive, after which the carrier base paper was peeled away, leaving the yellow dye stratum outward and protectively covered by a thin layer of matte polyethylene. The remaining portion of the print was mounted by applying the adhesive to the back side of the carrier base paper and bonding it to the card stock, so that the imaged emulsion side faced outward, the cyan stratum being outermost. A black paper strip was positioned over each of the mounted print portions to shield a part of the entire color spectrum, and two test panels were prepared from each print portion.

One test panel of each print portion was placed in a cylindrical chamber, mounted on a slowly rotating center-shaft, and for 114 hours continuously subjected to radiation from a bank of six 20-watt fluorescent sun lamps located around the circumference of the chamber and spaced an average distance of 7.6 centimeters from the test panel.

The second test panel of each print portion was placed for 306 hours in a light box maintained at 43° C. and illuminated by three 275-watt tungsten filament sunlamps spaced 40.6 centimeters apart and 76.2 centimeters above the test panel.

The black paper strips were then removed, and the areas of the prints which had been covered were designated "controls," while the adjacent unprotected areas were designated "irradiated". Visual examination showed the inverted emulsion samples of the invention to by significantly better than the emulsion-side-up samples of the prior art with respect to color loss and shift. To quantify the relative color changes, measurements of the cyan, magenta, yellow, and total density of each reference color band on the test prints were made using a MacBeth Model TR-524 Transmission Reflection Densitometer. Table A shows the values for the 114-hour ultraviolet light-irradiated samples, and Table B shows the values for the 306-hour sunlamp-irradiated samples.

(2) Cyan loss was significantly lower in inverted samples of the invention than in the emulsion-side-up samples of the prior art. Cyan loss in the emulsion-side-up samples was usually accompanied by a yellow gain.

(3) Magenta loss was slightly to moderately higher in the inverted samples of the invention than in the emulsion-side-up samples of the prior art.

(4) The general effect of inverting the imaged emulsion layers was a significant improvement in cyan and overall density preservation at some sacrifice to magenta and yellow preservation. Loss of yellow, however, was not readily apparent to the human eye.

TABLE A

Irradation: 114 hours in U.V. chamber
MacBeth Model TR-524 Transmission Reflection Densitometer
C = cyan filter M = magenta filter Y = yellow filter

| Reference Color | Control C | Control M | Control Y | Control No Filter | Irradiated C | Irradiated M | Irradiated Y | Irradiated No Filter | % Change After Irradiation C | % Change After Irradiation M | % Change After Irradiation Y | % Change After Irradiation No Filter |
|---|---|---|---|---|---|---|---|---|---|---|---|---|
| Inverted Sample According to the Invention | | | | | | | | | | | | |
| Purple | 0.48 | 0.94 | 0.65 | 0.66 | 0.46 | 0.88 | 0.65 | 0.63 | −4.2 | −6.4 | 0 | −4.5 |
| Blue | 1.38 | 0.93 | 0.61 | 1.12 | 1.38 | 0.92 | 0.66 | 1.10 | 0 | −1.1 | 8.2 | −1.8 |
| Green | 1.32 | 0.79 | 0.75 | 1.00 | 1.28 | 0.77 | 0.69 | 0.95 | −3.0 | −2.5 | −8.0 | −5.0 |
| Black | 1.24 | 1.18 | 1.22 | 1.17 | 1.24 | 1.19 | 1.15 | 1.18 | 0 | 0.8 | −5.7 | 0.9 |
| Gray | 0.30 | 0.32 | 0.34 | 0.30 | 0.30 | 0.34 | 0.41 | 0.31 | 0 | 6.2 | 20.6 | 3.3 |
| Yellow | 0.33 | 0.57 | 1.10 | 0.41 | 0.32 | 0.51 | 0.88 | 0.39 | −3.0 | −10.5 | −20.0 | −4.9 |
| Orange | 0.37 | 0.89 | 1.26 | 0.56 | 0.34 | 0.83 | 1.10 | 0.52 | −8.1 | −6.7 | −12.7 | −7.1 |
| Red | 0.41 | 1.02 | 0.97 | 0.64 | 0.40 | 0.98 | 0.85 | 0.61 | −2.4 | −3.9 | −12.4 | −4.7 |
| Non-Inverted Sample (Prior Art) | | | | | | | | | | | | |
| Purple | 0.50 | 1.12 | 0.73 | 0.71 | 0.34 | 1.08 | 0.79 | 0.60 | −32.0 | −3.6 | 8.2 | −15.4 |
| Blue | 1.98 | 1.12 | 0.68 | 1.41 | 1.68 | 1.15 | 0.79 | 1.34 | −15.1 | 2.6 | 16.2 | −4.9 |
| Green | 1.76 | 0.93 | 0.90 | 1.20 | 1.47 | 0.98 | 0.99 | 1.14 | −16.4 | 5.4 | 10.0 | −5.0 |
| Black | 1.75 | 1.69 | 1.70 | 1.65 | 1.41 | 1.71 | 1.79 | 1.49 | −20.0 | 1.2 | 5.3 | −9.7 |
| Gray | 0.32 | 0.36 | 0.35 | 0.32 | 0.20 | 0.37 | 0.44 | 0.26 | −37.5 | 2.8 | 25.7 | −18.8 |
| Yellow | 0.35 | 0.69 | 1.38 | 0.47 | 0.24 | 0.67 | 1.38 | 0.39 | −31.4 | −3.0 | 0 | −17.0 |
| Orange | 0.38 | 1.07 | 1.65 | 0.62 | 0.30 | 1.04 | 1.64 | 0.55 | −21.1 | −2.8 | −0.6 | −11.3 |
| Red | 0.45 | 1.30 | 1.21 | 0.73 | 0.36 | 1.29 | 1.28 | 0.66 | −20.0 | −0.8 | 5.8 | −9.6 |

TABLE B

Irradation: 306 hours in sunlight chamber
MacBeth Model TR-524 Transmission Reflection Densitometer
C = cyan filter M — magenta filter Y — yellow filter

| Reference Color | Control C | Control M | Control Y | Control No Filter | Irradiated C | Irradiated M | Irradiated Y | Irradiated No Filter | % Change After Irradiation C | % Change After Irradiation M | % Change After Irradiation Y | % Change After Irradiation No Filter |
|---|---|---|---|---|---|---|---|---|---|---|---|---|
| Inverted Sample According to the Invention | | | | | | | | | | | | |
| Purple | 0.50 | 1.00 | 0.71 | 0.69 | 0.50 | 0.97 | 0.69 | 0.68 | 0 | −3.0 | −2.8 | −1.4 |
| Blue | 1.48 | 1.09 | 0.72 | 1.24 | 1.40 | 1.01 | 0.70 | 1.18 | −5.4 | −7.3 | −2.8 | −4.8 |
| Green | 1.40 | 0.91 | 0.88 | 1.12 | 1.35 | 0.85 | 0.72 | 1.06 | −3.6 | −6.6 | −18.2 | −5.3 |
| Black | 1.41 | 1.39 | 1.38 | 1.37 | 1.40 | 1.34 | 1.19 | 1.34 | −0.7 | −3.6 | −13.8 | −2.2 |
| Gray | 0.35 | 0.38 | 0.39 | 0.35 | 0.32 | 0.36 | 0.41 | 0.32 | −8.6 | 5.2 | −5.1 | −8.6 |
| Yellow | 0.36 | 0.65 | 1.17 | 0.46 | 0.36 | 0.58 | 0.87 | 0.43 | 0 | −10.8 | −25.6 | −6.5 |
| Orange | 0.40 | 1.00 | 1.33 | 0.61 | 0.38 | 0.90 | 1.09 | 0.57 | −5.0 | −10.0 | −18.0 | −6.6 |
| Red | 0.44 | 1.15 | 1.08 | 0.70 | 0.45 | 1.11 | 0.90 | 0.69 | 2.3 | −3.5 | −16.7 | −1.4 |
| Non-Inverted Sample (Prior Art) | | | | | | | | | | | | |
| Purple | 0.53 | 1.14 | 0.78 | 0.75 | 0.32 | 1.12 | 0.86 | 0.59 | −39.6 | −1.8 | 10.2 | −21.3 |
| Blue | 2.01 | 1.13 | 0.72 | 1.43 | 1.31 | 1.09 | 0.85 | 1.16 | −34.8 | −3.5 | 18.1 | −18.9 |
| Green | 1.80 | 0.96 | 0.96 | 1.23 | 1.14 | 0.91 | 1.03 | 0.98 | −55.6 | −5.2 | 7.3 | −20.3 |
| Black | 1.75 | 1.70 | 1.71 | 1.65 | 1.11 | 1.61 | 1.79 | 1.25 | −36.6 | −5.3 | 4.7 | −24.2 |
| Gray | 0.34 | 0.37 | 0.37 | 0.34 | 0.17 | 0.37 | 0.49 | 0.25 | −50.0 | 0 | 32.4 | −26.5 |
| Yellow | 0.35 | 0.67 | 1.35 | 0.45 | 0.22 | 0.67 | 1.36 | 0.38 | −37.1 | 0 | 0.7 | −15.6 |
| Orange | 0.40 | 1.09 | 1.64 | 0.63 | 0.29 | 1.10 | 1.70 | 0.56 | −27.5 | 0.9 | 3.7 | −11.1 |
| Red | 0.46 | 1.30 | 1.24 | 0.73 | 0.34 | 1.30 | 1.28 | 0.64 | −26.1 | 0 | 3.2 | −12.3 |

Comparisons of the percent changes in the color and density readings in the control and irradiated areas lead to the following general observations:

(1) Overall density loss was significantly lower in the inverted samples of the invention than in the emulsion-side-up samples of the prior art.

It seems clear that the better color and density retention in the inverted samples of the invention is not atributable to the overlying thin matte polyethylene protective foil, it being known that the U.V. light-absorbing properties of polyethylene are not significant.

Hence, it is believed that the inversion of the emulsion layer was primarily responsible for the improvement. Normal positive color print paper, which is printed from color negatives, is manufactured with the stratum containing the yellow coupler on the bottom (next to the paper), the stratum containing the magenta coupler in the middle, and the stratum containing the cyan coupler on the top. When this order is reversed, as in the application of the photographic structure of this invention to a new surface (e.g., canvas, card stock, etc.), the yellow stratum is above the magenta and cyan. Yellow is a good absorber of short wave length, high energy light, such as ultraviolet, and is believed to protect the underlying magenta and cyan layers. A very slight additional protection may result from the light-diffusing properties of the polyethylene barrier foil's matte surface.

The invention lends itself to numerous applications, including some where conformability is not the prime consideration. For example, unpigmented adhesives can be used to transfer photographic images to smooth white surfaces such as card stock, while still retaining color fidelity. Thus, commercial artists can attain desirable artistic effects while saving time in preparing mockup packaging materials, limited copies of full color illustrated brochures, etc. The photographic image can be applied to translucent sheets for use in backlighted displays, to steel panels for use in the area of automotive graphics, to glass for an inexpensive simulation of stained glass, to enamel-painted panels for use as photographic decalcomania, to wooden boards for rustic effects, etc.

Fade resistance can be further enhanced by modifying the photographic paper construction used in the invention by incorporating a U.V.-absorbing layer between the first low density polyethylene foil and the stratum containing the yellow dye coupler. This layer could be either the subbing layer itself or an additional layer.

It will also be recognized that for outdoor use the photographic reproduction can be still further protected by adhering a vinyl foil over the first polyethylene foil, especially if the vinyl foil extends beyond the edges to seal out light and the elements. Additional fade resistance can also be imparted by incorporating U.V. absorbers in the vinyl foil.

What is claimed is:

1. A simple and convenient method of preparing a fade-resistant and abrasion-resistant full color photographic reproduction comprising the steps of a. obtaining a photographic paper comprising
   (1) a paper core having a face side and a back side,
   (2) a first low density polyethylene foil bonded to the face side but removable therefrom with a force of 6–10 grams per centimeter width,
   (3) a second low density polyethylene foil bonded to the back side,
   (4) overlying the first foil and bonded thereto a full-color light-sensitive element comprising a plurality of superposed strata of photographic emulsions containing disposed siver halide particles, each stratum containing a dye coupler, the outermost stratum containing a cyan or magenta coupler precursor and the innermost stratum containing a yellow coupler,
b. exposing the light-sensitive element through a colored negative to create a latent image and,
c. developing and fixing the latent image,
d. applying a uniform layer of adhesive over the outermost stratum,
e. bonding the image-bearing photographic paper to a desired substrate via said adhesive, and
f. stripping away the paper core and second polyethylene foil to leave a full-colored photograph bonded to said substrate, the outermost stratum of the previously light-sensitive element now containing the yellow dye, which absorbs ultraviolet radiation, whereby the photographic reproduction is rendered resistant to fading, said first polyethylene foil covering the previously light-sensitive element, whereby the photographic reproduction is protected from abrasion.

* * * * *